US009999575B2

(12) United States Patent
Lampe et al.

(10) Patent No.: US 9,999,575 B2
(45) Date of Patent: Jun. 19, 2018

(54) CONTAINER WITH A SPITTOON

(71) Applicant: R.J. REYNOLDS TOBACCO COMPANY, Winston-Salem, NC (US)

(72) Inventors: Matthew E. Lampe, Winston-Salem, NC (US); Pankaj C. Patel, Clemmons, NC (US); Michael F. Davis, Clemmons, NC (US); Yan Pu, Kernersville, NC (US); Karen W. Wallace, Winston-Salem, NC (US); Nicholas H. Watson, Westfield, NC (US); Samantha S. White, Thomasville, NC (US); Karter R. Yutzy, Kernersville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 104 days.

(21) Appl. No.: 14/881,961

(22) Filed: Oct. 13, 2015

(65) Prior Publication Data

US 2017/0100308 A1 Apr. 13, 2017

(51) Int. Cl.
*A61J 19/00* (2006.01)
*A24F 23/00* (2006.01)

(52) U.S. Cl.
CPC ..... *A61J 19/00* (2013.01); *A24F 23/00* (2013.01)

(58) Field of Classification Search
CPC ..... A24F 23/00; A61J 19/00
USPC ..... 4/258
See application file for complete search history.

(56) References Cited

U.S. PATENT DOCUMENTS

| | | | | |
|---|---|---|---|---|
| 2,034,322 | A * | 3/1936 | Anderson | A61J 19/00 4/274 |
| 4,098,421 | A | 7/1978 | Foster | |
| 4,190,170 | A | 2/1980 | Boyd | |
| 6,718,563 | B1 * | 4/2004 | Kreiensieck | A61J 19/00 4/258 |
| D574,709 | S | 8/2008 | Crotts et al. | |
| D649,284 | S | 11/2011 | Patel et al. | |
| 8,440,023 | B2 | 5/2013 | Carroll et al. | |
| 8,458,996 | B2 | 6/2013 | Bried et al. | |
| 8,567,597 | B2 | 10/2013 | Gibson et al. | |
| 8,910,781 | B2 | 12/2014 | Pipes et al. | |
| 9,205,959 | B2 | 12/2015 | Welk et al. | |
| 9,522,766 | B2 * | 12/2016 | Bechtold | B65D 31/12 |
| 2006/0101564 | A1 * | 5/2006 | Powdermaker | A61J 19/00 4/259 |
| 2010/0012534 | A1 | 1/2010 | Hoffman | |
| 2010/0018883 | A1 | 1/2010 | Patel | |
| 2010/0065076 | A1 | 3/2010 | Bergstrom et al. | |
| 2010/0065077 | A1 * | 3/2010 | Lofgreen-Ohrn | A24F 23/00 131/329 |
| 2012/0193265 | A1 | 8/2012 | Patel et al. | |
| 2013/0292279 | A1 | 11/2013 | Bengtsson et al. | |

* cited by examiner

*Primary Examiner* — J. Casimer Jacyna
(74) *Attorney, Agent, or Firm* — Womble Bond Dickinson (US) LLP

(57) ABSTRACT

A container is provided that includes a top cover, a bottom cover, a body portion configured to engage the top cover and the bottom cover to substantially enclose an internal space defined by the body portion, wherein the body portion includes an intermediate wall that divides the internal space into a first compartment and a second compartment, and a spittoon disposed within the second compartment.

5 Claims, 13 Drawing Sheets

CONTAINER WITH A SPITTOON

BACKGROUND

Field of the Disclosure

The present disclosure relates to containers, and more particularly, to packaging for products made or derived from tobacco, or that otherwise incorporate tobacco-related materials, and are intended for human consumption.

Description of Related Art

Tobacco may be enjoyed in a so-called "smokeless" form. Particularly popular smokeless tobacco products are employed by inserting some form of processed tobacco or tobacco-related material into the mouth of the user. See for example, the types of smokeless tobacco products, formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; U.S. Pat. No. 7,694,686 to Atchley et al.; U.S. Pat. No. 7,810,507 to Dube et al.; U.S. Pat. No. 7,819,124 to Strickland et al.; U.S. Pat. No. 7,861,728 to Holton, Jr. et al.; U.S. Pat. No. 7,901,512 to Quinter et al.; U.S. Pat. No. 8,168,855 to Neilsen et al.; U.S. Pat. No. 8,336,557 to Kumar et al.; and U.S. Pat. No. 8,469,036 to Strickland et al.; U.S. Pat. Pub. Nos. 2004/0020503 to Williams; 2006/0191548 to Strickland et al.; 2007/0062549 to Holton, Jr. et al.; 2008/0029116 to Robinson et al.; 2008/0029117 to Mua et al.; 2008/0173317 to Robinson et al.; 2008/0196730 to Engstrom et al.; 2008/0305216 to Crawford et al.; 2009/0065013 to Essen et al.; 2010/0291245 to Gao et al. and 2013/0206153 to Beeson et al.; PCT Pub. Nos. WO 04/095959 to Arnarp et al.; and WO 10/132,444 to Atchley; each of which is incorporated herein by reference.

Representative smokeless tobacco products that have been marketed include those referred to as CAMEL Orbs, CAMEL Strips and CAMEL Sticks by R. J. Reynolds Tobacco Company; GRIZZLY moist tobacco, KODIAK moist tobacco, LEVI GARRETT loose tobacco and TAYLOR'S PRIDE loose tobacco by American Snuff Company, LLC; KAYAK moist snuff and CHATTANOOGA CHEW chewing tobacco by Swisher International, Inc.; REDMAN chewing tobacco by Pinkerton Tobacco Co. LP; COPENHAGEN moist tobacco and RED SEAL long cut by U.S. Smokeless Tobacco Company; and Taboka by Philip Morris USA.

Representative types of snuff products, commonly referred to as "snus," which may comprise pasteurized or heat treated tobacco products, are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. have been marketed under the trade names such as CAMEL Snus Frost, CAMEL Snus Original and CAMEL Snus Spice by R. J. Reynolds Tobacco Company. Snus products, such as CAMEL Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products typically do not require expectoration by the user. Other pouch types of smokeless tobacco products include those marketed as COPENHAGEN Pouches, SKOAL Bandits, SKOAL Pouches, REVEL Mint Tobacco Packs by U.S. Smokeless Tobacco Company; and MARLBORO Snus by Philip Morris USA.

Various types of containers for dispensing smokeless tobacco products, and particularly for dispensing smokeless tobacco products intended for human consumption, are known in the art. Such containers are often characterized by a hand-held size that can be easily stored and transported. For example, snus products have been packaged in tins, "pucks" or "pots" that are manufactured from metal or plastic. See, for example, those types of containers generally disclosed in U.S. Pat. No. 4,098,421 to Foster; U.S. Pat. No. 4,190,170 to Boyd and U.S. Pat. No. 8,440,023 to Carroll et al.; and U.S. Patent Pub. Nos. 2010/0065076 to Bergstrom et al.; 2010/0065077 to Lofgreen-Ohrn et al.; 2012/0024301 to Carroll et al. and 2012/0193265 to Patel et al.; each of which is incorporated by reference herein. Yet other types of containers for smokeless types of tobacco products are set forth in U.S. Pat. No. 8,458,996 to Bried et al.; D574,709 to Crotts et al. and D649,284 to Patel et al.; U.S. Patent Pub. Nos. 2008/0202956 to Welk et al., 2010/0012534 to Hoffman, and 2010/0018883 to Patel et al.; and U.S. patent application Ser. No. 13/739,776, filed Jan. 11, 2013, to Pipes et al.; as well as the various types of containers referenced in U.S. Patent Pub. No. 2013/0206153 to Beeson et al.; each of which is incorporated by reference herein. Further, U.S. Pat. No. 8,567,597 to Gibson et al. discloses a compartment container for snus, and is incorporated herein by reference in its entirety.

A desirable feature for certain containers is the provision of a spittoon that may be configured to capture any usage byproducts. In particular, a container with a spittoon disposed therein may provide a user with an immediate opportunity to begin consumption of the smokeless tobacco product. Further, a container including a spittoon therein may decrease the incidences of users littering the environment with waste products produced from consuming a smokeless tobacco product. Additionally or alternatively, a container providing a reusable spittoon therein may also provide for a decrease in waste as the use of multiple spittoons may be eliminated.

BRIEF SUMMARY OF THE DISCLOSURE

The above and other needs are met by aspects of the present disclosure which, in one aspect, provides a container that includes a top cover, a bottom cover, and a body portion configured to engage the top cover and the bottom cover to substantially enclose an internal space defined by the body portion. The body portion includes an intermediate wall that divides the internal space of the container into a first compartment and a second compartment. Additionally, the container includes a spittoon disposed within the second compartment.

In some aspects, the container includes a dispensing unit that is configured to provide the spittoon on demand. The dispensing unit includes an outer shell that defines a dispensing aperture and a shell cavity, and a base member that is configured to retain at least one spittoon thereon. The outer shell is configured to operably engage the base member and enclose the base member within the shell cavity.

The dispensing unit may further include a biasing element configured to operably engage the base member. According to one aspect, the base member is configured to retain a stack of disposable spittoons thereon, and operable engagement of the biasing element with the base member causes, at least in part, the base member to direct the stack of disposable spittoons towards the dispensing aperture.

According to some aspects, the outer shell and the base member may be configured to rotate with respect to one another. The base member may be configured to retain a plurality of disposable spittoons thereon that are arranged about a central axis of the base member in substantially equal angular intervals. Additionally, the outer shell and base member may be configured to operably engage one another such that the operable engagement between the outer shell and the base member provides for positioning the dispensing aperture proximate to any one of the disposable spittoons.

In some aspects, the dispensing unit is configured to be received within the second compartment. The dispensing unit may be disposed such that the dispensing aperture is disposed proximate the bottom cover when the bottom cover is operably engaged with the body portion. Additionally, operable engagement between the bottom cover and the body portion may limit access to the dispensing aperture.

According to another aspect, a container may include a dispensing unit configured to provide the spittoon on demand, and the dispensing unit may include a base member configured to retain at least one spittoon thereon. Additionally, the bottom cover of the container may define a dispensing aperture and a shell cavity therein, and the bottom cover may be configured to operably engage the base member and enclose the base member within the shell cavity.

In some aspects, a container includes a spittoon support member that is disposed within the second compartment and is configured to operably engage and deploy the spittoon. The spittoon support member may be further configured to be positioned in a stored configuration and an open configuration, and positioning the spittoon support member in the open configuration provides for the spittoon support member to deploy and provide support for the spittoon. The spittoon support member may be operably engaged and integrally formed with the bottom cover. In another aspect, the spittoon support member may be operably engaged and integrally formed with the body portion of the container. Additionally, the spittoon support member may include a biasing member that is configured to automatically position the spittoon support member to the open configuration upon removal of the bottom cover.

According to one aspect, the spittoon may be a disposable spittoon that includes a water impermeable material configured to operably engage the spittoon support member. In this regard, operably engagement between the disposable spittoon and the spittoon support member may define a spittoon cavity therein. In some aspects, the spittoon may be configured to be manipulated between a stored position and a deployed position. According to another aspect, the spittoon, when disposed in the stored position, may be dimensioned to be housed within the second compartment of the container. Additionally, when the spittoon is disposed in the deployed position, the spittoon is configured to provide a spittoon cavity to function as a spittoon. In one aspect, the spittoon may further include a plurality of concentric annular ring portions operably engaged with one another. When the spittoon is disposed in the stored position, the concentric annular ring portions may be disposed coplanar with respect to one another. According to some aspects, at least a portion of the spittoon may be operably engaged with the bottom cover, and when disposed in the deployed position, the concentric annular ring portions may extend longitudinally from the bottom cover. In another aspect, at least a portion of the spittoon may be operably engaged with the bottom cover, and when disposed in the deployed position, the concentric annular ring portions may extend longitudinally from the body portion.

Additionally, the container may include a spittoon that defines a sealed interior volume that is configured to receive a fluid therein. When the spittoon is disposed in the deployed position, the sealed interior volume may be substantially filled with the fluid (e.g., air). Likewise, when the spittoon is disposed in the stored position, the sealed interior volume may be substantially devoid of the fluid.

These and other features, aspects, and advantages of the disclosure will be apparent from a reading of the following detailed description together with the accompanying drawings, which are briefly described below.

BRIEF DESCRIPTION OF THE DRAWINGS

Figure 1:
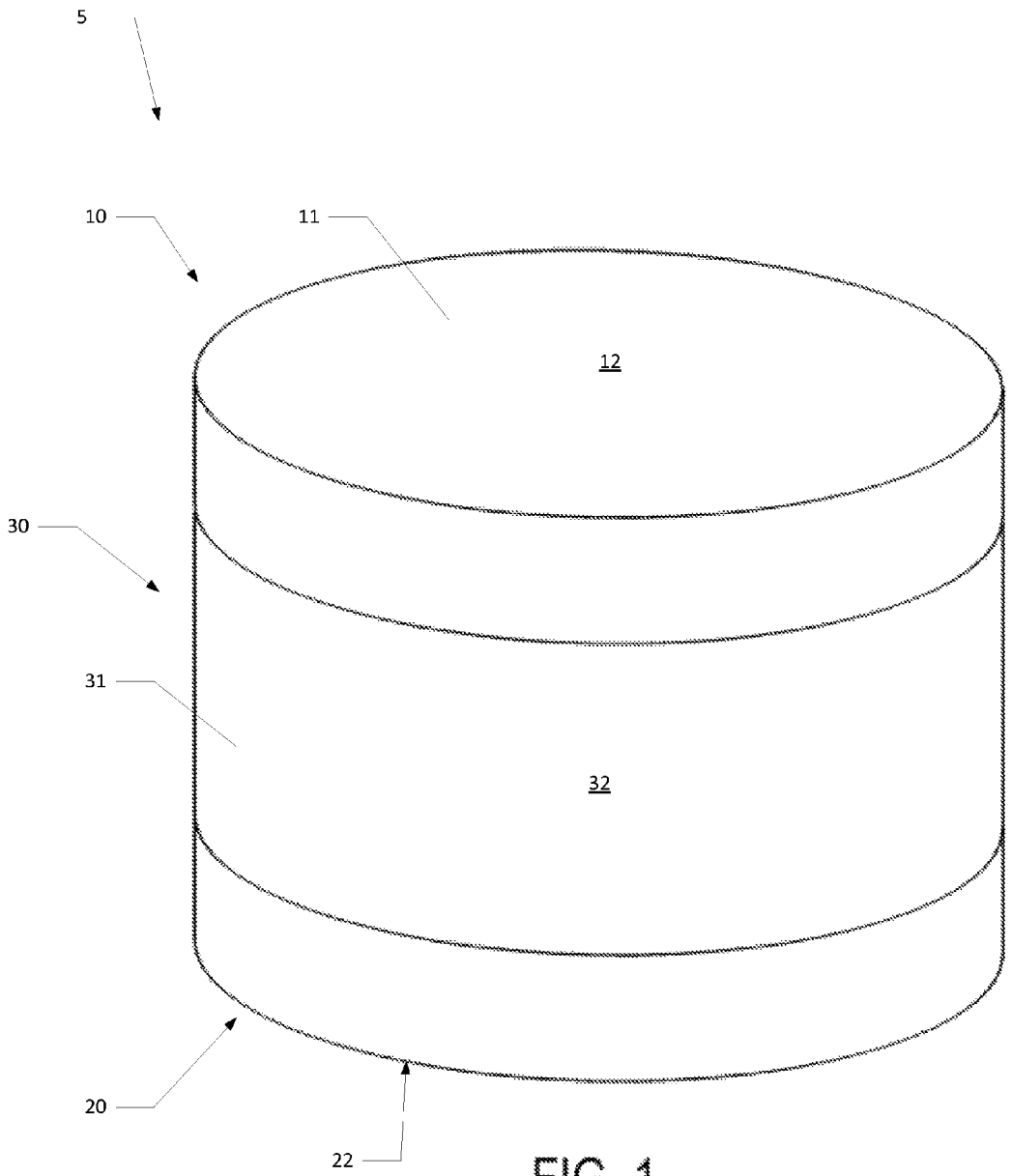
Figure 2:
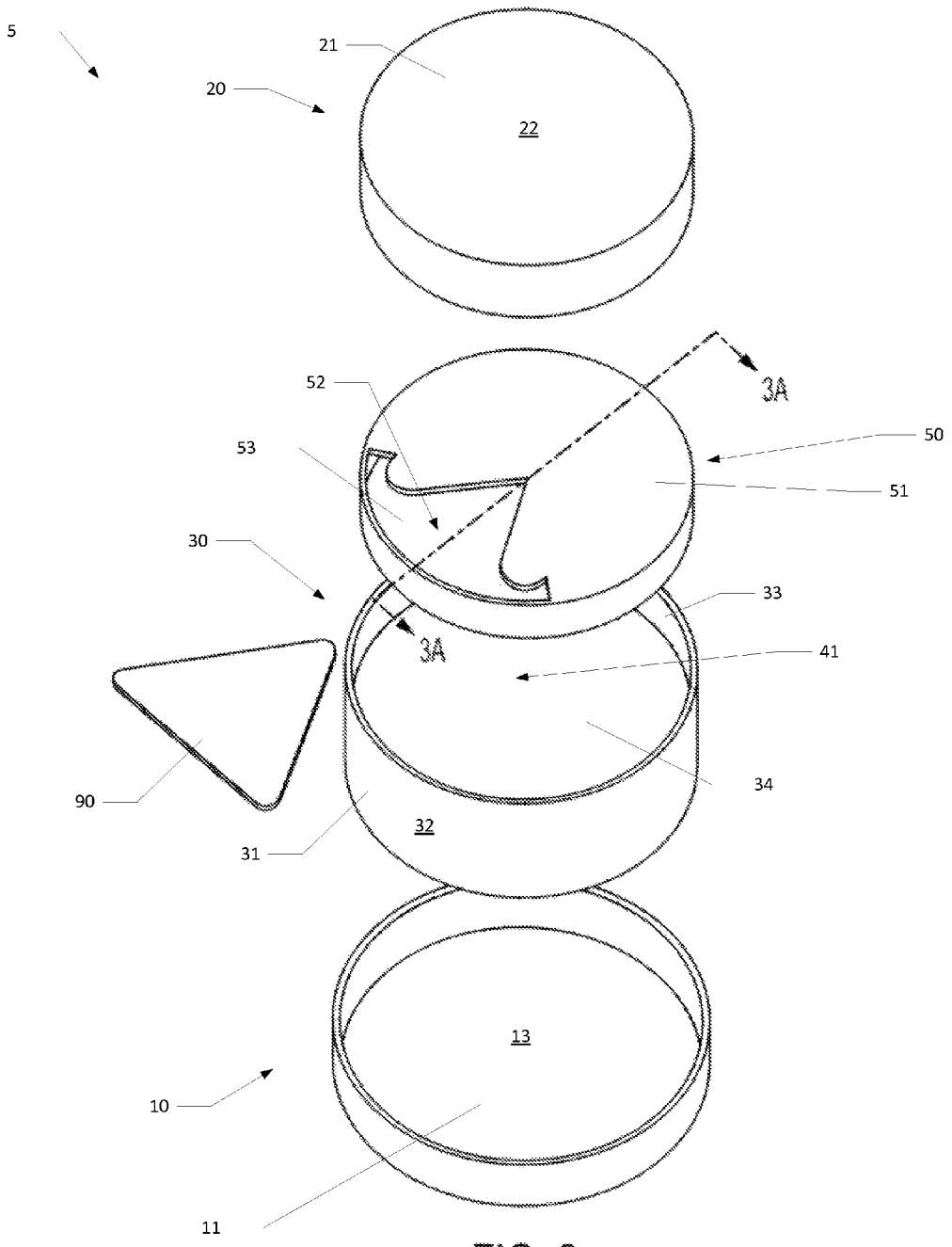
Figure 3A:
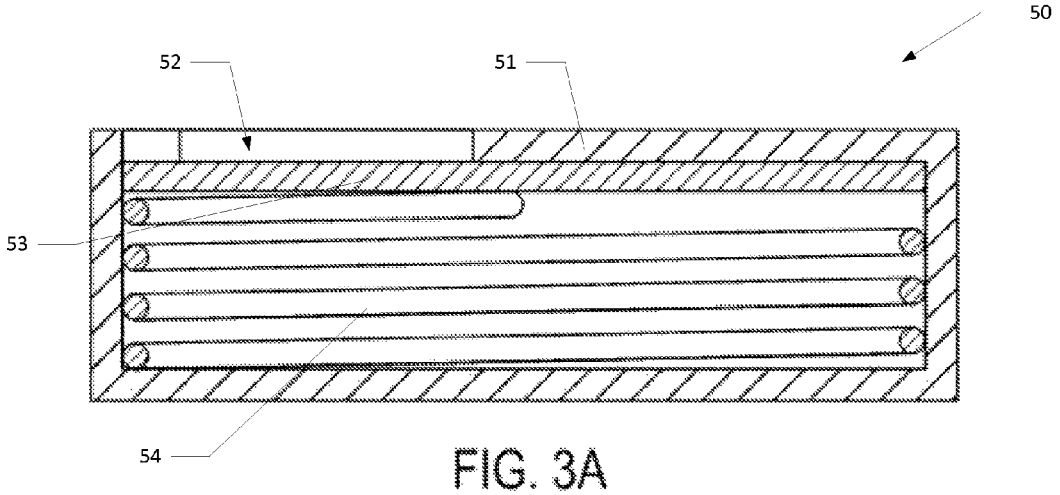
Figure 3B:
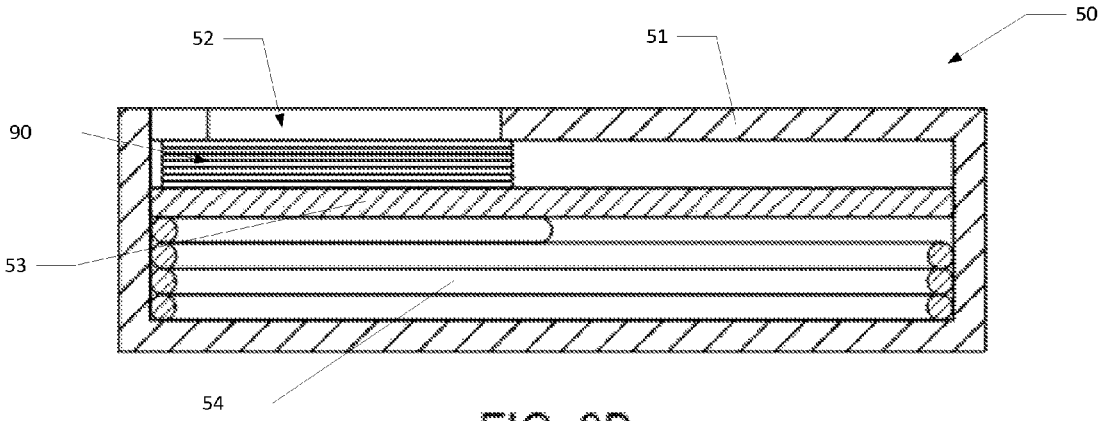
Figure 4:
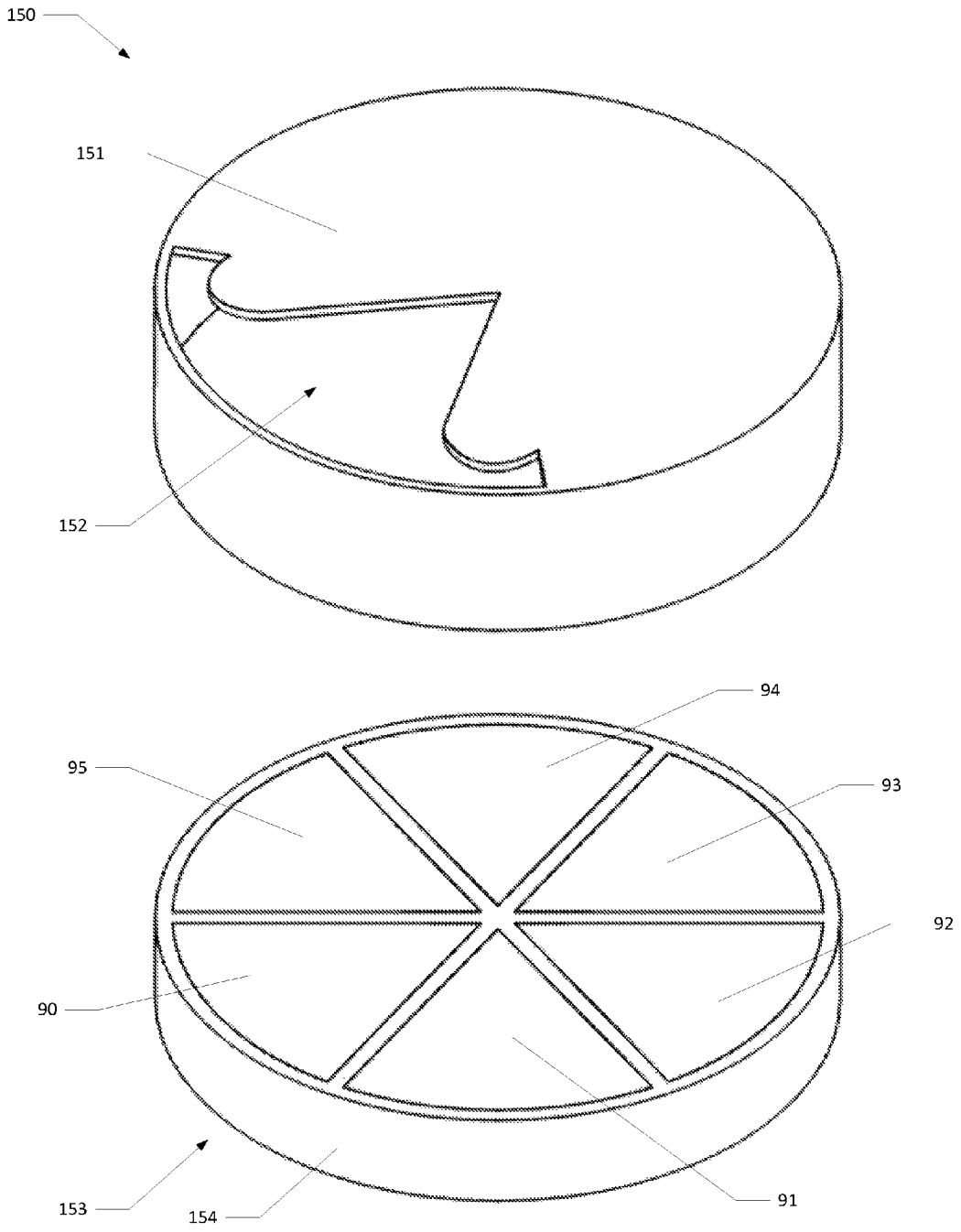
Figure 5A:
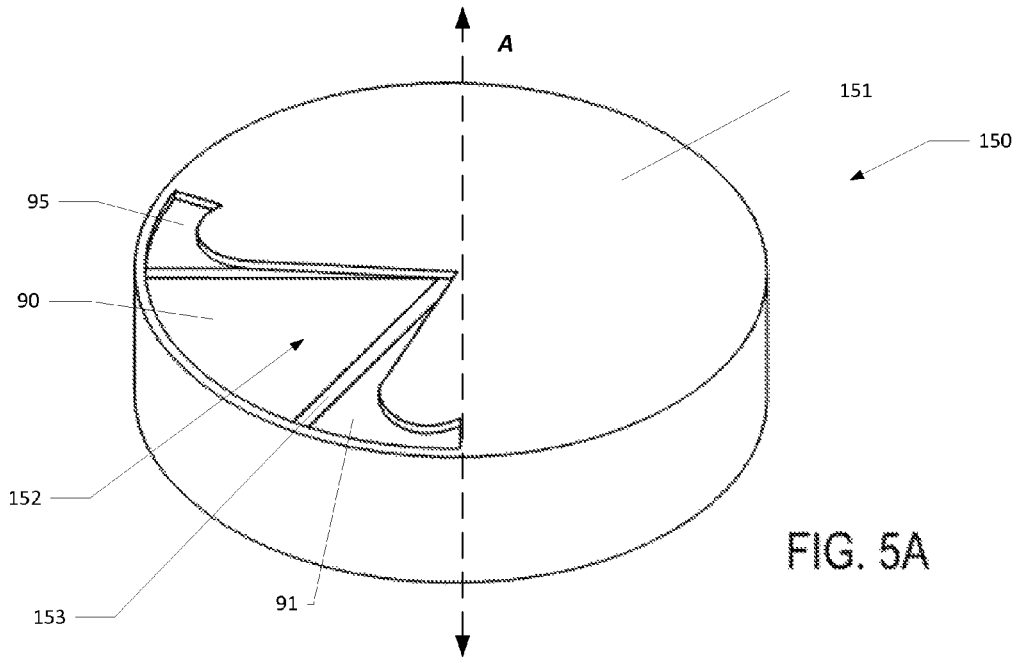
Figure 5B:
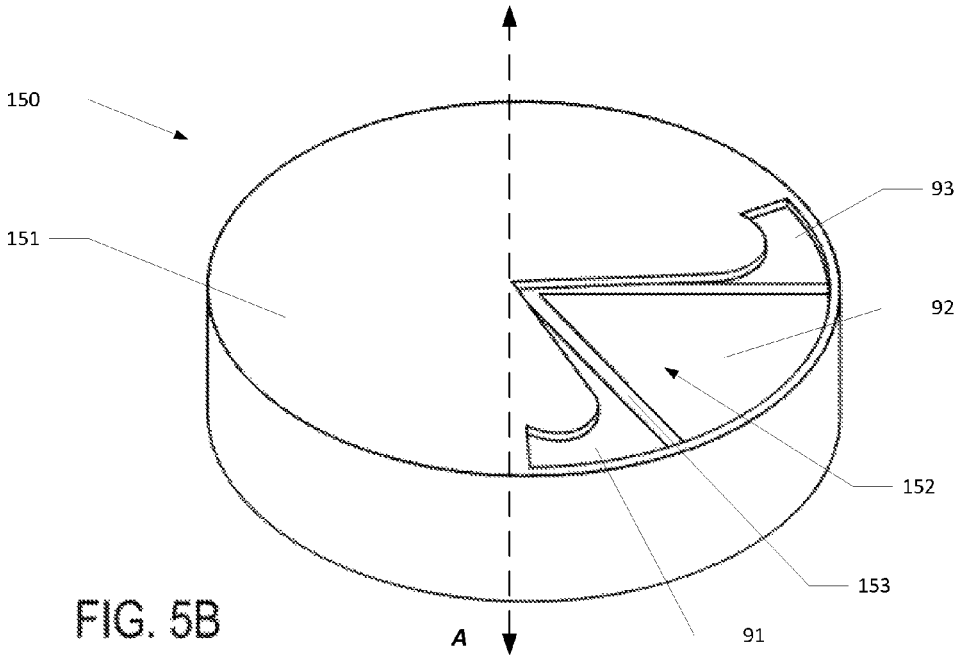
Figure 6:
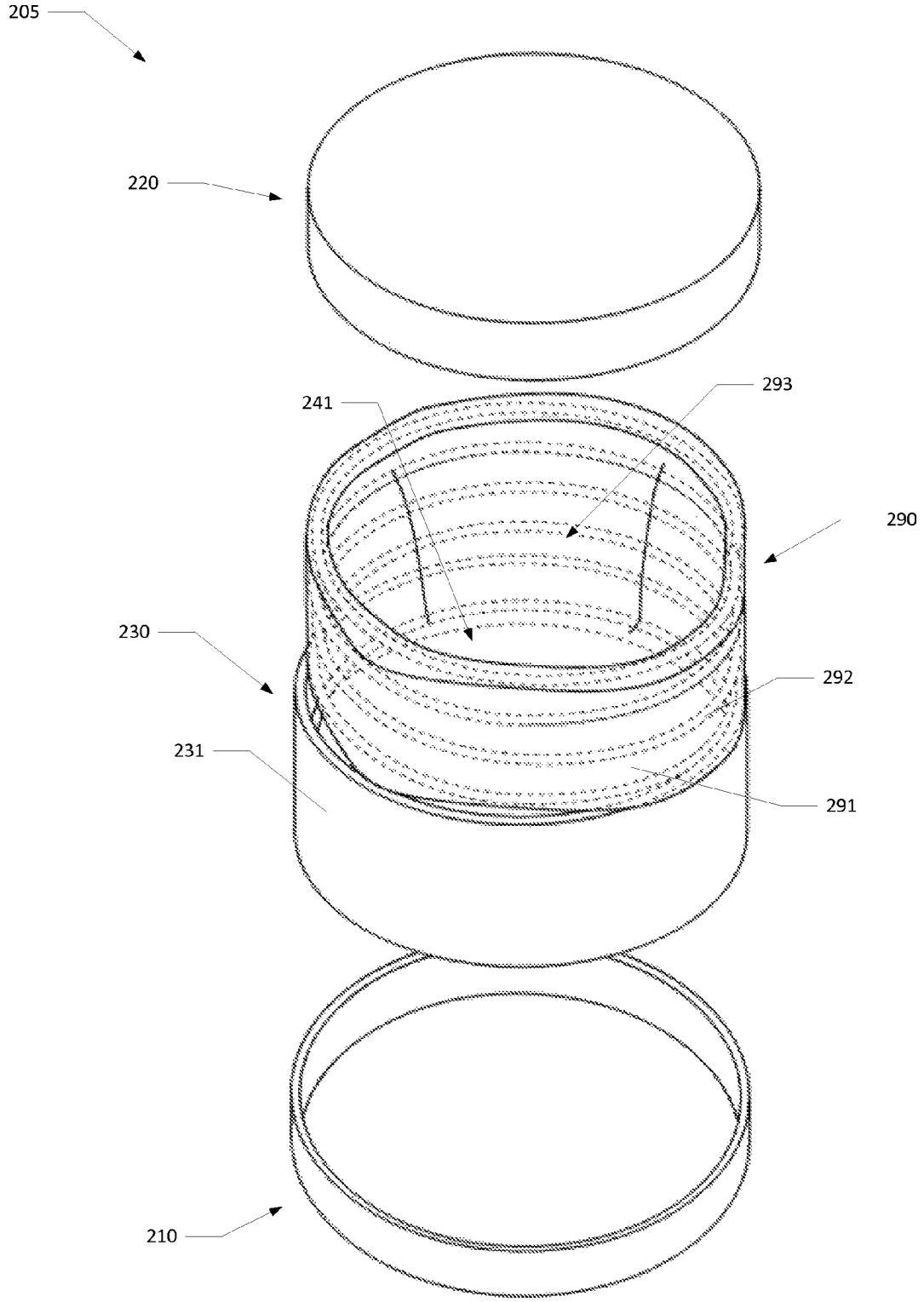
Figure 7:
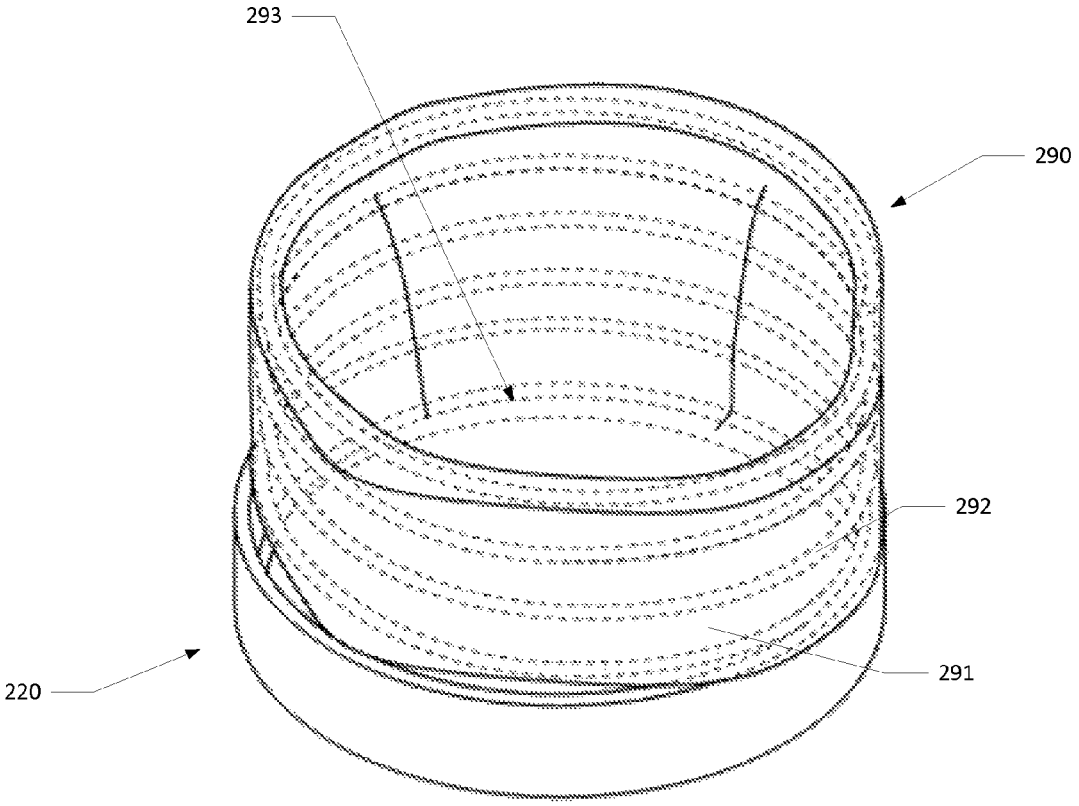
Figure 8A:
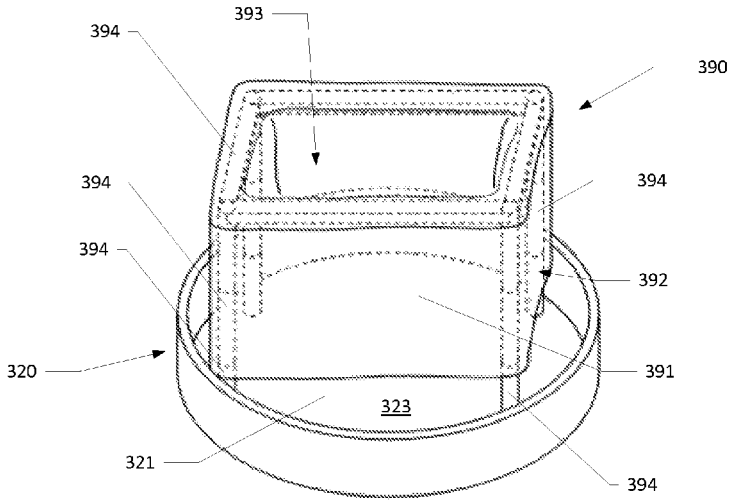
Figure 8B:
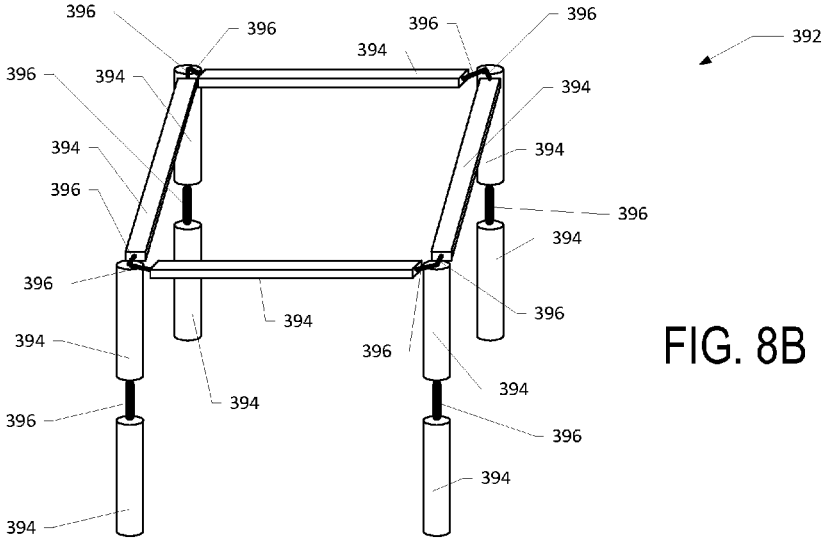
Figure 9A:
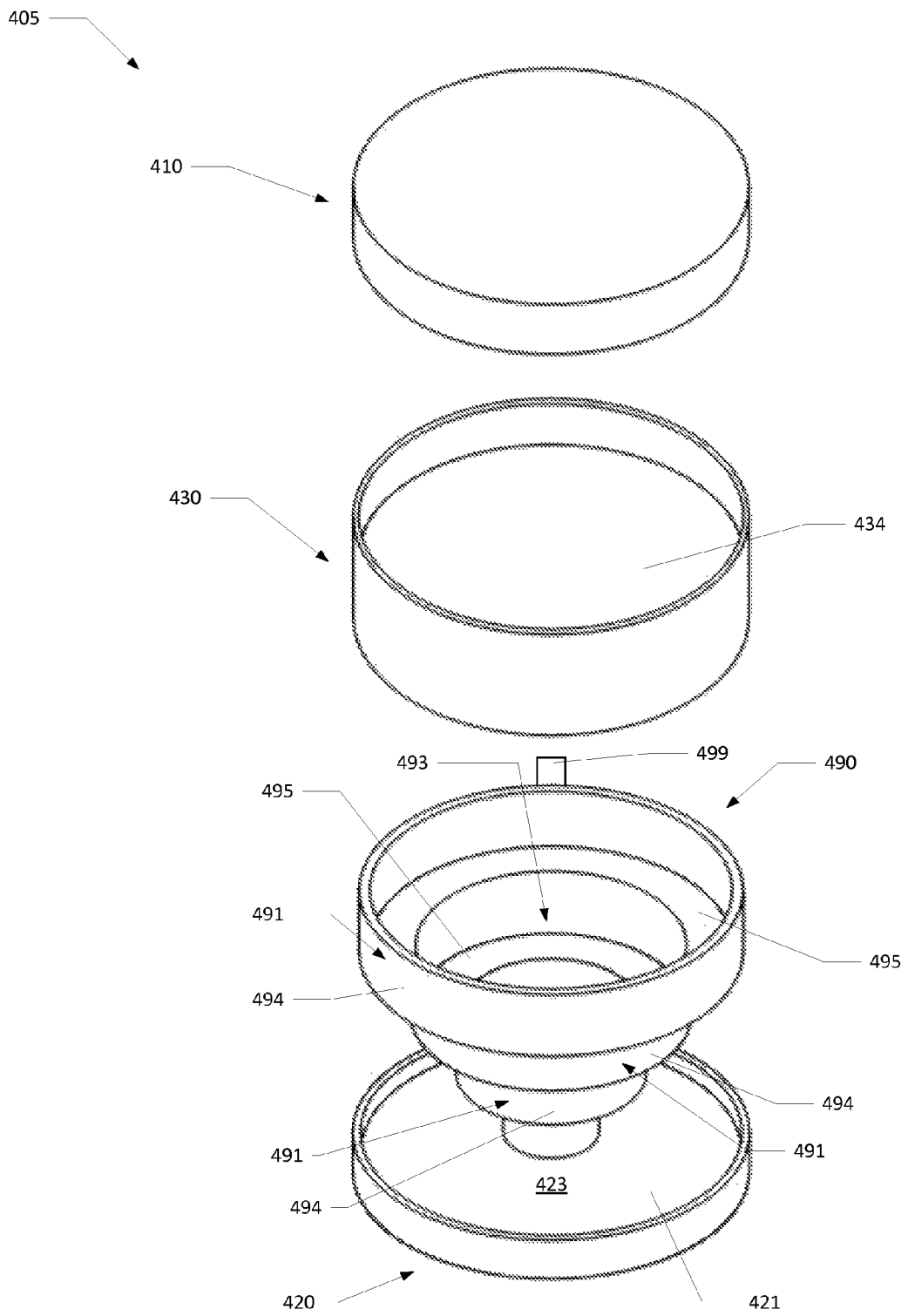
Figure 9B:
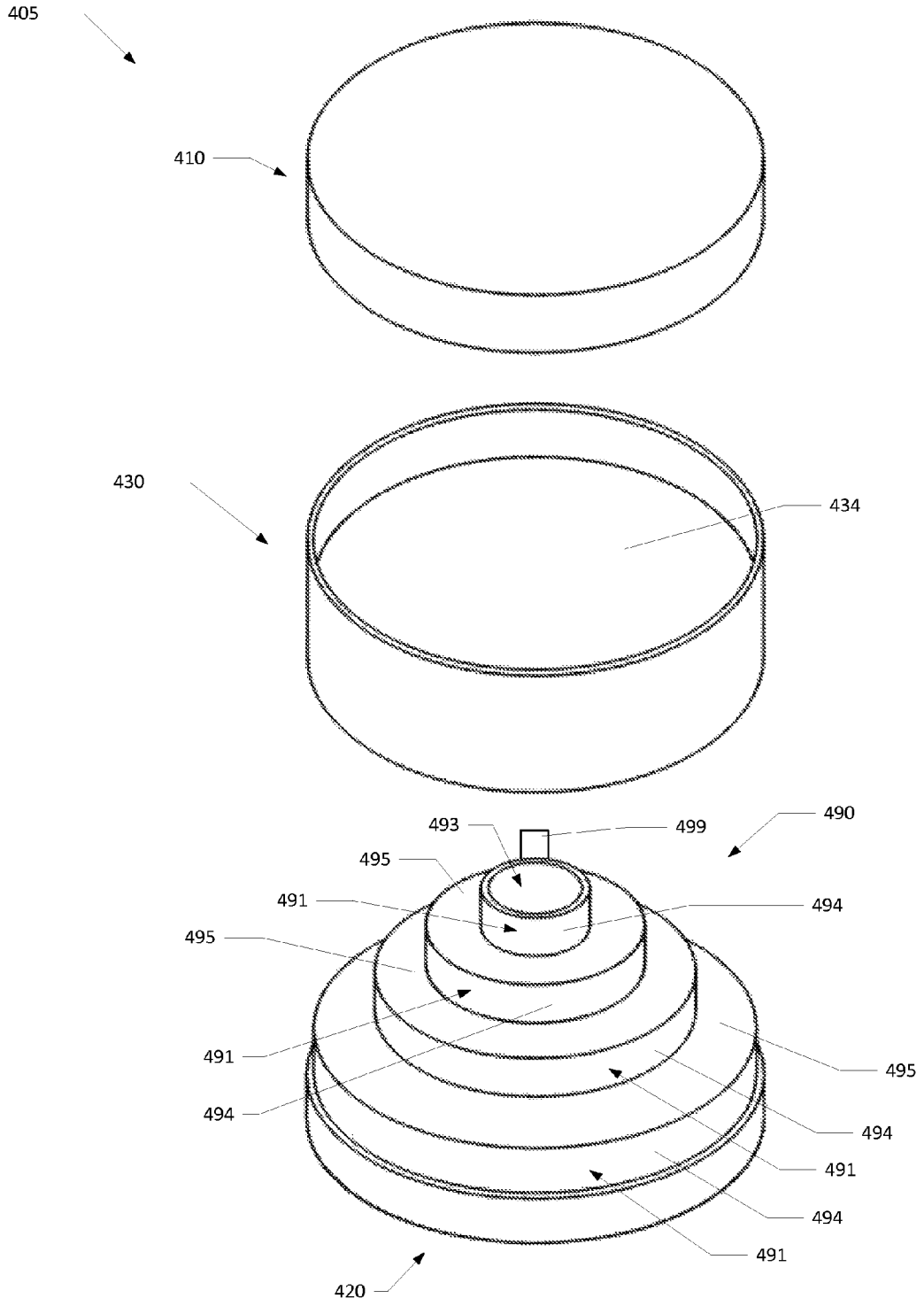
Figure 10:
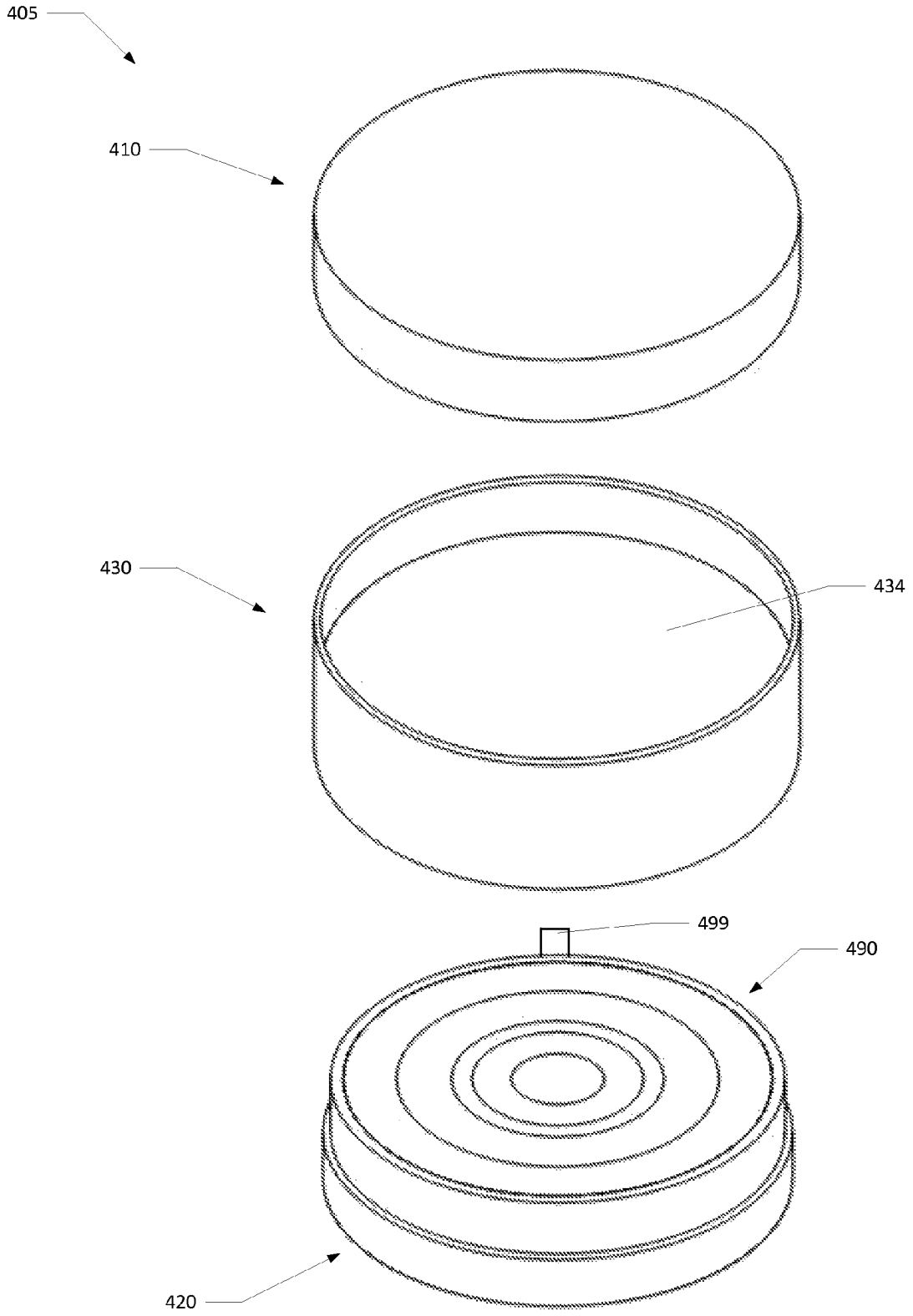
Figure 11:
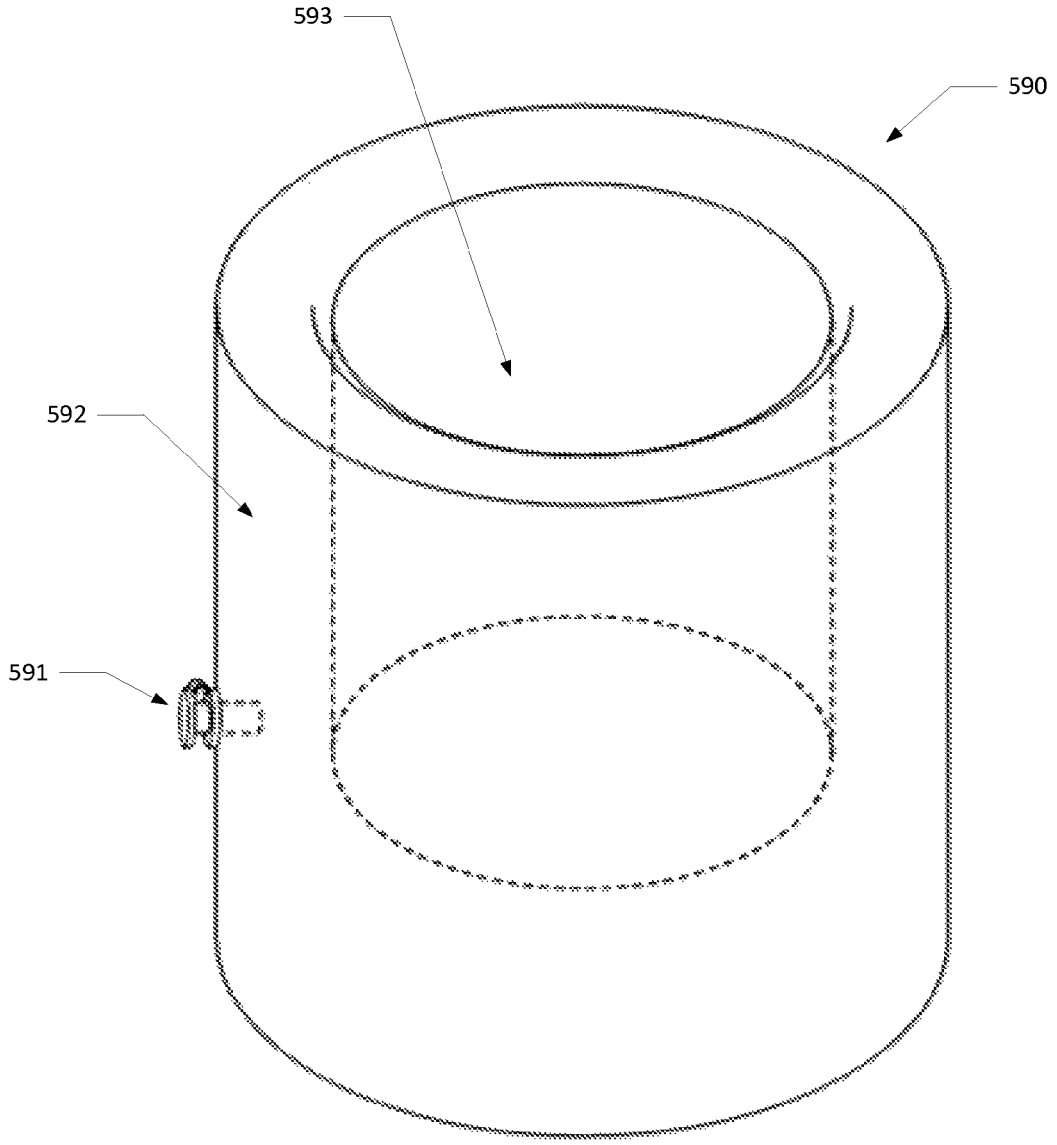
Figure 12:
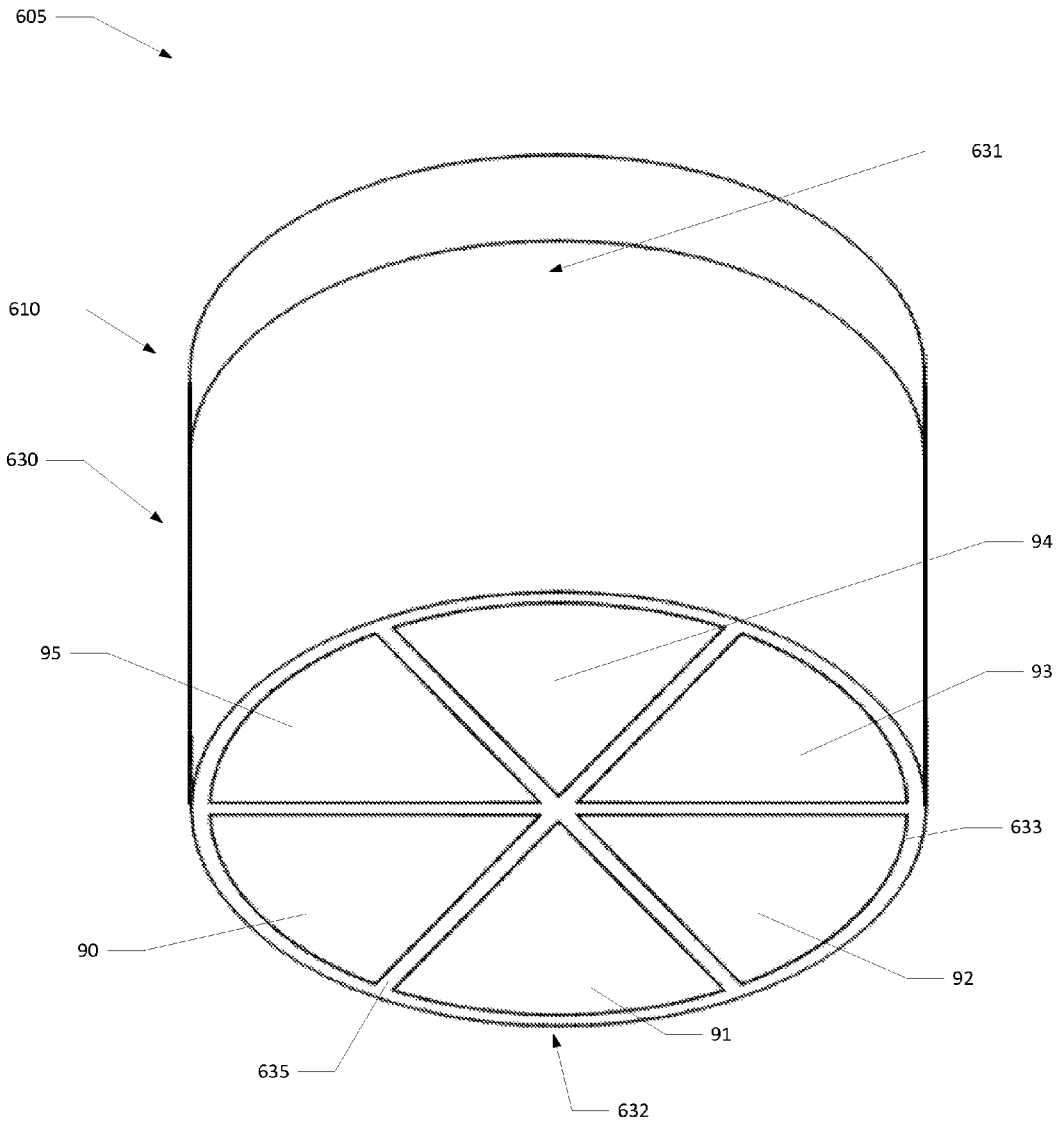

Having thus described the disclosure in the foregoing general terms, reference will now be made to the accompanying drawings, which are not necessarily drawn to scale, and wherein:

FIG. 1 illustrates a perspective view of a container with a spittoon according to one aspect of the present disclosure;

FIG. 2 illustrates an exploded perspective view of a container with a spittoon according to one aspect of the present disclosure;

FIG. 3A illustrates a cross-sectional view of the spittoon dispenser shown in FIG. 2 along line 3A according to one aspect of the present disclosure;

FIG. 3B illustrates a cross-sectional view of a spittoon dispenser with a plurality of spittoons according to one aspect of the present disclosure;

FIG. 4 illustrates an exploded view of a spittoon dispenser according to one aspect of the present disclosure;

FIG. 5A illustrates a spittoon dispenser according to one aspect of the present disclosure;

FIG. 5B illustrates a spittoon dispenser according to one aspect of the present disclosure;

FIG. 6 illustrates an exploded perspective view of a container with a spittoon according to one aspect of the present disclosure;

FIG. 7 illustrates a perspective view of a bottom cover of a container that includes a spittoon according to one aspect of the present disclosure;

FIG. 8A illustrates a perspective view of a bottom cover of a container that includes a spittoon according to one aspect of the present disclosure;

FIG. 8B illustrates a perspective view of a spittoon support structure that includes a plurality of spittoon support members and spittoon member connectors according to one aspect of the present disclosure;

FIG. 9A illustrates an exploded perspective view of a container that includes a bottom cover with a spittoon disposed in an operating position according to one aspect of the present disclosure;

FIG. 9B illustrates an exploded perspective view of a container that includes a bottom cover with a spittoon disposed in an operating position according to one aspect of the present disclosure;

FIG. 10 illustrates an exploded perspective view of the container in FIG. 10 with the spittoon of the bottom cover disposed in a stored position according to one aspect of the present disclosure;

FIG. 11 illustrates a perspective view of a spittoon according to one aspect of the present disclosure; and FIG. 12 illustrates a bottom perspective view of a container with a spittoon according to one aspect of the present disclosure.

DETAILED DESCRIPTION OF THE DISCLOSURE

The present disclosure will now be described more fully hereinafter with reference to exemplary aspects thereof. These exemplary aspects are described so that this disclosure will be thorough and complete, and will fully convey the scope of the disclosure to those skilled in the art. Indeed, the disclosure may be expressed in many different forms and should not be construed as limited to the aspects set forth herein; rather, these aspects are provided so that this disclosure will satisfy applicable legal requirements. As used in the specification, and in the appended claims, the singular forms "a", "an", "the", include plural referents unless the context clearly dictates otherwise.

Various container aspects described herein can be used to store various solid products, but are particularly well-suited for products designed for oral consumption. Exemplary consumable products that are often packaged in such containers include a wide variety of moist consumer products, including tobacco products of the type that have a smokeless form. Various forms of suitable smokeless tobacco products are those types of products set forth and generally described in U.S. Patent App. Pub. No. 2012/0193265 to Patel et al. and U.S. Patent Pub. No. 2013/0206153 to Beeson et al., which are both incorporated herein by reference in their entirety. Of particular interest are exemplary tobacco products that include tobacco formulations in loose form, such as moist snuff products. Other exemplary types of smokeless tobacco products include the types of products set forth in U.S. Patent App. Pub. No. 2012/0024301 to Carroll et al., which is incorporated by reference herein. Exemplary loose form tobacco used with the containers of the present disclosure may include tobacco formulations associated with, for example, commercially available GRIZZLY moist tobacco products and KODIAK moist tobacco products that are marketed by American Snuff Company, LLC. Exemplary snus forms of tobacco products are commercially available as CAMEL Snus by R. J. Reynolds Tobacco Company.

The shape of the outer surface of the containers of the disclosure can vary. Although the container aspects illustrated in the figures have certain contours, containers with other exterior surface designs also can be suitably adapted and used. For example, the sides or edges of the containers of the disclosure can be flattened, rounded, or beveled, and the various surfaces of the edges can be concave or convex. Further, the opposing sides, ends, or edges of the container can be parallel or non-parallel such that the container expands in one or more dimensions. See, for example, the types of containers, components, component arrangements and configurations, and constructions thereof set forth in U.S. Pat. No. 8,458,996 to Bried et al.; U.S. Pat. No. D649,284 to Patel et al.; U.S. Patent App. Pub. No. 2010/0018883 to Patel et al.; U.S. Patent App. Pub. No. 2013/0206153 to Beeson et al.; and U.S. patent application Ser. No. 13/739,776, filed Jan. 11, 2013, to Pipes et al.; each of which are incorporated by reference herein.

The dimensions of the containers described herein can vary without departing from the disclosure. However, in some preferred aspects, the containers can be described as having a cylindrical size suitable for handheld manipulation and operations, as shown in FIG. 1. Exemplary dimensions for such handheld generally cylindrical containers include diameters in the range of about 50 mm to about 130 mm, and more typically about 60 mm to about 115 mm. Exemplary wall thicknesses include the range of about 0.5 mm to about 4.75 mm, and more typically about 0.8 mm to about 4.6 mm. Exemplary depths for handheld containers, in some aspects, range from about 5 mm to about 50 mm, more typically about 8 mm to about 45 mm, and most often about 15 mm to about 40 mm.

Additionally, the size of the containers described herein may be changed. For example, the containers may be sized for promotional purposes by providing increased dimensions by upwardly scaling the container dimensions by certain multipliers. For example, the dimensions of the container may be scaled upwardly by a multiple of about 1 to about 10 times. In this regard, whereas a conventional container according to aspects of the present disclosure may be configured to store about 0.08 ounces to 1.2 ounces of a tobacco and/or tobacco-related material, an oversized container may be configured to store, for example, 2.4 ounces or 7.2 ounces of the tobacco and/or tobacco-related material. Accordingly, the dimensions and capacities disclosed herein are provided for example purposes only and may be modified to suit particular purposes.

Referring to FIGS. 1 and 2, one aspect of one type of container 5 is illustrated that is representative of the present disclosure. The generally cylindrical container 5 may be formed by a top cover 10, a bottom cover 20, and an open-ended body portion 30. The top cover 10 may include a top wall 11, which in some aspects, may be substantially planar. Likewise, the bottom cover 20 may include a bottom wall 21, which in some aspects, may also be substantially planar. The body portion 30 may include a side wall 31, which in some aspects may be generally cylindrical, that defines a peripheral portion of the container 5 such that the side wall 31 includes an outer peripheral surface 32 and an inner peripheral surface 33, as shown in FIG. 2. Likewise, the bottom wall 21 of the bottom cover 20 may define a peripheral bottom portion of the container such that the bottom wall includes an outer bottom surface 22 and an inner bottom surface 23. Additionally, the top wall 11 of the top cover 10 may define a peripheral top portion of the container such that the top wall includes an outer top surface 12 and an inner top surface 13.

According to one aspect, the body portion 30 may be configured to operably engage the top cover 10 and the bottom cover 20 so as to substantially enclose an internal space defined by the body portion, the top cover, and/or the bottom cover. As shown in FIG. 2, the body portion 30 may include an intermediate wall 34 that divides the internal space into a first compartment (not shown) and a second compartment 41. In some aspects, the intermediate wall 34 of the body portion 30 may be substantially planar.

The material of construction of the body portion 30 of the container 5, and/or the top cover 10 and the bottom cover 20 can vary. Exemplary preferred materials include metal and synthetic plastic materials. Polymeric materials that can be extruded and/or molded into desired shapes are typically utilized, such as polypropylene, polyethylene, polystyrene, polyamide, and/or the like. For example, plastic materials may be injection molded to form any one of the body portion 30, the top cover 10, and the bottom cover 20. Exemplary preferred body portions are those that incorporate polymeric materials such as those types of plastic-type materials commonly used for popular types of smokeless tobacco products. For example, exemplary body portions formed from polymeric materials are of comparable components and general structure to those used for commercially available CAMEL Snuff, GRIZZLY and KODIAK products that are marketed by American Snuff Company, LLC. Various metallic materials may additionally or alternatively be employed to form the body portion 30, top cover 10 and/or bottom cover 20 of the container 5. Metallic body portions formed from metallic materials are available from J. L. Clark of Rockford, Ill., Crown Cork and Seal of Philadelphia, Pa., and Independent Can of Belcamp, Md. The metallic materials may include tinplate or tinplated steel in some aspects.

The manner by which the body portion 30 of the container 5 is manufactured can vary. As discussed herein, the intermediate wall 34 may be substantially irreversibly (e.g., irreleasably and permanently) attached to the remainder of the body portion 30. In a preferred aspect, the intermediate wall 34 and the side wall 31 that defines the side walls of the first compartment and the second compartments 41 are integral with one another. As such, those components of the body portion 30 are manufactured as a single piece. In one aspect, the intermediate wall 34 and the side wall 31 may be joined by injection molding or any of the various other formation and coupling techniques discussed herein.

In some aspects, the first compartment and/or the second compartment 41 may be configured to receive, house, and/or store a plurality of tobacco-related products. In particular, the first compartment may be configured to store a plurality of smokeless tobacco products. For example, when the tobacco-related product is a loose tobacco product, the amount of tobacco product stored in the first compartment may vary from approximately 20 g to approximately 50 g, and most often about 30 g to about 40 g of moist, loose tobacco product. In some aspects, the tobacco-related product may be a pouched or snus-type of product. In such aspects, the amount of tobacco product stored in the first compartment may vary, and will depend on factors such as the size of the container 5, the size of the tobacco product, the degree of container fill, and the like. Typically, the number of stored pouched tobacco product units will vary from approximate 5 to approximately 30, more typically about 10 to about 25, and often about 15 to about 20.

According to one aspect, the container 5 may be configured to house at least one spittoon configured to receive and/or store user waste while consuming the smokeless tobacco product stored within the container 5. For example, as shown in FIGS. 2, 3A, 3B, 4, 5A and 5B, a plurality of disposable spittoons 90 may be configured to receive and/or store user waste during consumption of a smokeless tobacco product. According to another aspect, as shown in FIGS. 6, 7, and 8A, the container 5 may include a disposable spittoon 290, 390 configured to receive and/or store user waste while consuming the smokeless tobacco product stored within the container. In some aspects, as shown in FIGS. 9A, 9B, 10, and 11, the container 5 may include a reusable spittoon 490, 590 configured to receive and/or store user waste while consuming the smokeless tobacco product stored within the container. In this regard, aspects of the present disclosure may provide a spittoon configured to receive and/or store user waste while consuming the smokeless tobacco product. In particular, the spittoon may comprise at least one material and/or layer that are substantially impermeable to liquid.

According to one aspect, the spittoon may comprise a web of a sheet-like paper material. As used herein, the term "paper" is meant to include any sheet or board made from a fibrous cellulosic material and encompasses paperboard. Desirable paper materials are thin, and have reasonably high tensile strengths, resiliencies and relatively good flexibilities. In particular, it is desirable that the web have a good "hand" to hold a fold but not tear, crinkle, shatter or otherwise break during a folding and/or pleating process. It is desirable that the modulus of the web is appropriate such that folding and/or pleating readily occurs. In particular, the paper material should not be so hard that it does not pleat, nor should the paper material be so soft that spittoons having poor resiliency are provided.

In some aspects, the spittoon may include a hydrophobic layer formed from a nonwoven web composition configured to enhance hydrophobicity. The hydrophobic layer may include hydrophobic cellulose fibers, such as those that are commercially available as Tencel® Biosoft from Lenzing of Austria and Olea Fiber from Kelheim of Germany. According to another aspect, the spittoon may include the single web of sheet-like paper material that is treated to enhance the hydrophobicity. For example, the single web of sheet-like paper material may be coated with a moisture barrier coating agent that includes hydrophobic compounds such as various waxes (e.g., carnauba wax).

In another aspect, the spittoon may include a first layer that includes a web of the sheet-like paper material and a second layer configured to be substantially impermeable to liquids. For example, the second layer may include a foil sheet that is substantially impermeable to liquids. In some aspects, the foil sheet, which may include a metallic material, may be laminated and/or attached to the first layer (i.e., the web of sheet-like paper material). According to another aspect, the foil sheet may be formed by printing a metallic ink on the web of sheet-like paper material such that the printed metallic ink forms a foil layer on the paper layer (and/or may be at least partially absorbed into and/or integrated with the paper portion). Such a heat conductive ink may include, for example, carbon, graphite, grapheme, silver, and/or any other suitable metallic material or combinations thereof to prohibit the flow of liquid through the web of sheet-like paper material.

According to another aspect, the spittoon may comprise a polymeric material such as, for example polyactic acid, polyhydroxyalkanoates, polypropylene, polyethylene, polystyrene, polyamide, and/or the like that is substantially impermeable to liquids. In some aspects, the spittoon may include a first layer that includes a web of the sheet-like paper material and a second layer that includes the polymeric material. In another aspect, the spittoon may include a single layer formed from the polymeric material. In yet another aspect, the spittoon may include a first layer formed from the web of the sheet-like paper material, a second layer formed from the metallic material, and a third layer formed from the polymeric material.

Additionally or alternatively, the spittoon may further include a material that is provided with a coating and/or subjected to treatment or manufacturing process, which provides desirable qualities. As mentioned previously, the spittoon may include the paper material that is coated with a hydrophobic coating material to enhance the hydrophobicity of the spittoon. In another aspect, the spittoon may be provided with an anti-microbial agent for controlling and/or inhibiting the growth of bacteria, yeast, and/or fungi.

According to some aspects, the spittoon may further include a plurality of microstructures and/or surface features configured to provide additional desirable qualities. For example, the spittoon may include a plurality of microstructures and/or surface features that provide a desired contact angle between a drop of liquid and the surface of the spittoon. In particular, the hydrophobicity of a material can be evaluated, for example, by measuring the contact angles between the drop of liquid and the surface of the material, as is known in the art.

In another aspect, the spittoon may include a sealing element configured to secure a spittoon cavity. In particular, a spittoon may include a sealing element for fully encapsulating any waste material disposed within the spittoon cavity. For example, as shown in FIGS. 6, 7, and 8A, the spittoon 290, 390 may define a spittoon cavity 293, 393 and may further include a sealing element may include a zip-locking mechanism, an adhesive mechanism, and/or any other suitable mechanism for sealing the spittoon so as to fully secure the spittoon cavity. In some aspects, the sealing element may be configured to prevent any waste material from exiting the spittoon cavity when the sealing element is operably engaged.

Returning to FIGS. 2, 3A, 3B, 4, 5A, and 5B, a plurality of disposable spittoons 90 may be disposed within a dispensing unit, such as a spittoon dispenser 50, 150 configured to provide the disposable spittoon 90 on demand. The spittoon dispenser 50, 150 may be stored in the first compartment and/or the second compartments 41. In another aspect, the spittoon may be disposed within the first compartment and/or second compartments 41. Further still, in some aspects, the spittoon may be integrally formed with the intermediate wall 34, the bottom wall 21, and/or top wall 11 of the container 5.

Referring to FIGS. 2, 3A and 3B, the container 5 may include a spittoon dispenser 50 configured to provide a disposable spittoon 90 on demand. As shown in FIGS. 2, 3A and 3B, the spittoon dispenser 50 may be configured to house a plurality of spittoons 90 configured to receive and/or store user waste while consuming the smokeless tobacco product stored within the container 5. In some aspects, the disposable spittoon 90 may be configured to collapse into a substantially planar shape so as to be stackable with respect to one another.

In particular, FIGS. 3A and 3B illustrates a spittoon dispenser 50 configured to store a plurality of disposable spittoons 90 that are stacked on top of another. In particular, FIG. 3A illustrates a spittoon dispenser 50 in an unfilled state, while FIG. 3B illustrates a spittoon dispenser 50 in a filled state. The spittoon dispenser 50 may include an outer shell 51 that defines a dispensing aperture 52 therethrough. In one aspect, the outer shell 51 may be shaped complimentarily with the first compartment and/or second compartments 41 of the container 5 so as to be received within the first compartment and/or second compartments 41. In some aspects, the outer shell 51 of the spittoon dispenser 50 may be shaped complimentarily with the second compartment 41 such that the spittoon dispenser operably engages the inner peripheral surface 33 of the side wall 31 in a friction fit. In particular, the outer shell 51 of the spittoon dispenser 50 may be substantially cylindrical in shape so as to be received in the first compartment and/or second compartments 41, which may be shaped substantially as a cylindrical cavity.

In some aspects, as shown in FIGS. 3A and 3B, the spittoon dispenser 50 further includes a base plate, such as a dispensing plate 53 configured to receive the plurality of disposable spittoons 90 thereon. In addition, the spittoon dispenser 50 may include a biasing element 54 configured to bias the dispensing plate 53 towards the dispensing aperture 52. As shown in FIG. 3A, the biasing element 54 biases the dispensing plate 53 such that in the unfilled state, the dispensing plate 53 may substantially abut an inner surface of the outer shell 51. FIG. 3B illustrates the spittoon dispenser 50 in a filled state where the biasing element 54 biases the dispensing plate 53 such that the plurality of disposable spittoons 90 are stacked proximate the dispensing aperture 52, and a first disposable spittoon substantially abuts an inner surface of the outer shell 51. As such, according to one aspect, when a first disposable spittoon within a stack of disposable spittoons is removed from the spittoon dispenser 50 via the dispensing aperture 52, a second disposable spittoon in the stack is urged towards the inner surface of the outer shell 51 as the biasing element 54 biases the dispensing plate 53 towards the inner surface of the outer shell 51.

In some aspects, a spittoon dispenser 150 may be configured to rotate about a base member 153, as shown in FIGS. 4, 5A and 5B. In particular, according to one aspect, a spittoon dispenser 150 may include an outer shell 151 that defines a dispensing aperture 152. The outer shell 151 of the spittoon dispenser 150 may be similarly shaped and configured to the outer shell 51 of the spittoon dispenser 50. In particular, the spittoon dispenser 151 defines a dispensing aperture 152, and may be shaped complimentarily with the first compartment and/or second compartments 41 of the container 5 so as to be received within the first compartment and/or second compartments 41. In some aspects, the outer shell 151 of the spittoon dispenser 150 may be shaped complimentarily with the second compartment 41 such that the spittoon dispenser 150 operably engages the inner peripheral surface 33 of the side wall 31 in a friction fit. In another aspect, the outer shell 151 of the spittoon dispenser 150 may be shaped complimentarily with the second compartment 41 such that the spittoon dispenser 150 is rotatable within the second compartment 41. In particular, the outer shell 151 of the spittoon dispenser 150 may be substantially cylindrical in shape so as to be received in the first compartment (not shown) and/or second compartments 41, which may be shaped substantially as a cylindrical cavity.

In addition, the outer shell 151 may be shaped and configured to operably engage the base member 153 and enclose the base member 153 within a cavity defined by the outer shell 151. Additionally or alternatively, the base member 153 may be configured to rotate with respect to the outer shell 151 about the longitudinal axis A, as shown in FIGS. 5A and 5B. In particular, the base member 153 may be configured to rotate about its longitudinal axis and shaped complimentarily with the outer shell 151 such that the base member 153 may rotate within the complimentarily-shaped cavity defined by the outer shell 151. For example, the base member 153 may be substantially shaped as a cylindrical body such that the base member 153 may rotate within a complimentarily-shaped cylindrical cavity defined by the outer shell 151.

Additionally, the base member 153 may be configured to retain at least one spittoon thereon (e.g., disposable spittoon 90), as shown in FIG. 4. In particular, the base member 153 may be configured to retain a plurality of disposable spittoons 90, 91, 92, 93, 94, 95 arranged about the periphery of the base member 153. As shown in FIG. 4, the disposable spittoons 90, 91, 92, 93, 94, 95 may be arranged about a central longitudinal axis of the base member 153 in substantially equal angular intervals. As such, the base member 153 and/or the outer shell 151 may rotate about the longitudinal axis of the container 5 such that operable engagement between the base member 153 and the outer shell 151 provides for positioning the dispensing aperture 152 proximate to any one of the disposable spittoons 90, 91, 92, 93, 94, 95. In particular, the base member 153 and/or the outer shell 151 may rotate with respect to one another such that the dispensing aperture 152 travels circumferentially along the peripheral side wall 154 of the base member 153 so as to provide access to any one of the disposable spittoons 90, 91, 92, 93, 94, 95. Further, FIGS. 5A and 5B illustrate the base member 153 and/or the outer shell 151 positioned in a first position in FIG. 5A and a second position in FIG. 5B. In particular, as shown in FIG. 5A, the spittoon dispenser 150 may be oriented such that a first disposable spittoon 90 is accessible via the dispensing aperture 152 in the first position, while FIG. 5B illustrates the dispensing aperture 152 having changed position due to the rotation of the base member 153 and/or outer shell 151 such that a second disposable spittoon 92 is accessible via the dispensing aperture 152 in the second position.

As previously mentioned, the spittoon dispensers 50, 150 shown in FIGS. 2, 3A, 3B, 4, 5A and 5B may be configured to be received within the first compartment (not shown) and/or second compartment 41 of the body portion 30 of the container 5. When the spittoon dispenser 50, 150 is disposed within the second compartment 41, the dispensing aperture 52, 152 is disposed opposite from the intermediate wall 34 of the body portion 30. As such, when the body portion 30 and the bottom cover 20 are not operably engaged with one another, the dispensing aperture 152 is accessible. Likewise, when the body portion 30 and the bottom cover 20 are operably engaged with one another, the dispensing aperture 152 is inaccessible. Further, the body portion 30 and the top cover 10 may operably engage one another in a similar fashion such that when the spittoon dispenser 50, 150 is disposed within the first compartment, the top cover 10 may limit access to the dispensing aperture 52, 152 when the top cover 10 is operably engaged with the body portion 30.

In another aspect, a spittoon dispenser may include a base member 53, 153 configured to retain at least one spittoon 90 thereon and shaped complimentarily with the first compartment (not shown) and/or second compartment 41 so as to be received within the first compartment and/or second compartment 41. Additionally, the bottom cover 20 may define a dispensing aperture similar to the dispensing apertures 52, 152 defined by the outer shell 51, 151. According to one aspect, the bottom cover 20, the side wall 31, and the intermediate wall 34 may together define a shell cavity, such as the second compartment 41, which is configured to receive the base member 53, 153 therein. As such, when the base member 53, 153 is disposed within the second compartment 41, and the bottom cover 20, which defines a dispensing aperture, is operably engaged with the body portion 30, the bottom cover 20 may provide access to a disposable spittoon 90 on demand via the dispensing aperture defined by the bottom cover 20.

FIG. 6 illustrates another aspect of the present disclosure that provides a container 205 that includes a top cover 210, a bottom cover 220, a body portion 230, and a spittoon 290 configured to receive and/or store user waste while consuming the smokeless tobacco product in an operating or open configuration. In particular, a spittoon 290 may include a spittoon support member 292 or support structure configured to operably engage and deploy a spittoon liner 291. In some aspects, the liner 291 may include any suitable materials configured to retain and/or store any user waste produced from consuming the smokeless tobacco product. For example, the liner 291 may include a liquid impermeable material such as, for example polypropylene, polyethylene, polystyrene, polyamide, polyactic acid, polyhydroxyalkanoates, and/or the like. Further, the liner 291 may include any suitable materials configured to be collapsible and/or malleable such that when the spittoon 290 is disposed in a stored or closed configuration, the liner 291 is fully enclosed within the enclosed second compartment 241, which may be defined by the bottom cover 220, and at least a portion of the side wall 231 and the intermediate wall (not shown) of the body portion 230.

In some aspects, the spittoon support structure 292 may be configured to operably engage the spittoon liner 291 such that when the spittoon support structure 292 is disposed in the open configuration, the spittoon support structure 292 deploys and provides support for the spittoon liner 292. For example, when the spittoon support structure 292 operably engages, deploys and provides support for the spittoon liner 291 in the open configuration, the spittoon liner 291 may be substantially shaped as a cylindrical container that defines a spittoon cavity 293. In some aspects, the spittoon liner 291 may be detachable from the spittoon support structure 292 such that a new and unused spittoon liner 291 may be operably engaged with the spittoon support structure 292 before each use.

In some aspects, when the spittoon support structure 292 and the spittoon liner 291 are disposed in the stored configuration, the spittoon support structure 292 and the spittoon liner 291 are configured to be fully enclosed within the second compartment 241. In particular, the spittoon support structure 292 may be configured such that when the bottom cover 220 and the body portion 230 are operably engaged with one another, the spittoon support structure 292 and the spittoon liner 291 are fully enclosed within the second compartment 241. For example, according to some aspects, the spittoon support structure 292 may be integrally formed and/or operably engaged with the intermediate wall 234, as shown in FIG. 6. In another aspect, the spittoon support structure 292 may be integrally formed and/or operably engaged with the bottom cover 220, as shown in FIG. 7. As such, when the bottom cover 220 operably engages the body portion 230, the spittoon support structure 292 may be configured to compress in height such that the height of the compressed spittoon support structure 292 is less than or equal to the height of the enclosed second compartment 241, which may be defined by the bottom cover 220, and at least a portion of the side wall 231 and the intermediate wall 234 of the body portion 230. In one aspect, the spittoon support structure 292 may include a spring element configured to compress in height, as shown in FIGS. 6 and 7, such that the spittoon support structure 292 and the spittoon liner 291 are fully enclosed within the second compartment 241.

In another aspect, as shown in FIGS. 8A and 8B, a spittoon support structure 392 may include a plurality of spittoon support members 394 and a plurality of spittoon member connectors 396. In some aspects, the plurality of spittoon support members 394 may be configured to attach to one another with the spittoon member connectors 396 so as to form a unitary spittoon support structure 392. Like the spittoon support structure 292 shown in FIGS. 6 and 7, the spittoon support structure 392 shown in FIGS. 8A and 8B is configured to operably engage a spittoon support liner 391. The spittoon support structure 392 may be configured to operably engage the spittoon liner 391 such that when the spittoon support structure 392 is deployed to the open configuration, the spittoon support structure 392 provides support for the spittoon liner 391. In particular, the spittoon support structure 392 may provide support such that the spittoon liner 391 forms a spittoon cavity 393, as shown in FIG. 8A.

Additionally, according to one aspect, the spittoon support structure 392 and the spittoon liner 391 are configured to be manipulated between an open configuration and a stored configuration. In particular, the spittoon support structure 392 and/or the spittoon liner 391, when disposed in the stored configuration, are configured to be fully enclosed within the second compartment 341. For example, according to some aspects, the spittoon support structure 392 may be integrally formed and/or operably engaged with an intermediate wall of a body portion. In another aspect, as shown in FIG. 8A, the spittoon support structure 392 may be integrally formed and/or operably engaged with the bottom cover 320. In particular, the spittoon support structure 392 may be integrally formed and/or operably engaged with an inner bottom surface 323 of a bottom wall 321 of the bottom cover 320. As such, when the bottom cover 320 operably engages the body portion (not shown), the plurality of spittoon support members 394 of the spittoon support structure 392 may be configured to disengage and/or detach from one another such that the unitary spittoon support structure 392 comprises a plurality of individual spittoon support members 394 that are connected via spittoon member connectors 396. Thus, the plurality of detached individual spittoon support members 394 and the spittoon liner 391 are configured to be fully encapsulated within the enclosed second compartment 341 when the spittoon support structure 392 and the spittoon liner 391 are disposed in the stored configuration.

In one aspect, a first spittoon support member 394 having a first end and a second may be operably engaged with a spittoon member connector 396 disposed proximate either the first or second end of the spittoon support member 394. As such, a first spittoon support member 394 may be securely connected to a second spittoon support member 394 via a spittoon member connector 396 that is disposed therebetween. In particular, as shown in FIG. 8B, a first spittoon support member 394 may have be operably engaged with a spittoon member connector 396, which may be disposed proximate the first end of the first spittoon support member 394. The spittoon member connector 396 may also be operably engaged with a second end of a second spittoon support member 394. According to some aspects, the spittoon member connector 396 may be a biasing member configured to bias the first end of the first spittoon support member 394 towards the second end of the second spittoon support member 394. In particular, the spittoon member connector 396 may be any suitable material having an elasticity and/or spring force configured to bias the first and second spittoon support members toward one another. For example, in one aspect, the spittoon member connector 396 may include a nylon-wrapped rubber bungee cord and/or a nylon-wrapped silicone bungee cord. In another aspect, a second spittoon support member 394 may be operably engaged with a first spittoon member connector 396 disposed proximate the second end of the second spittoon support member 394 and may be operably engaged with a second and third spittoon member connector 396 disposed proximate the first end of the second spittoon support member 394. As such, the second spittoon support member 394 may be configured to operably engage a first spittoon support member proximate the second end of the second spittoon support member, and may be further configured to operably engage a third and fourth spittoon support member proximate the first end of the spittoon support member via the spittoon member connectors disposed between each of the spittoon support members.

According to another aspect, the spittoon support structure 392 may be manipulated from the stored configuration to the open configuration by engaging any of the spittoon support members 394, as shown in FIG. 8B. For example, each of the plurality of spittoon support members 394 and the plurality of spittoon member connectors 396 may be operably connected to one another such that manipulating any one of the spittoon support members 394 from the stored configuration to the open configuration causes the remaining spittoon support members 394 and spittoon support connectors 396 to move from the stored configuration to the open configuration. In some aspects, the spittoon support connectors 396 may include a scissor-like joint member operably engaged with at least two spittoon support members. The spittoon support connectors 396 may be configured to provide for the folding, manipulation, and/or actuation of the spittoon support members 394 between the stored configuration and the open configuration such that the spittoon support structure 392 deployed in the open configuration is greater in size than the spittoon support structure 392 deployed in the stored configuration.

In another aspect, as shown in FIGS. 9A, 9B and 10, a container 405 may include a top cover 405, a body portion 430, a bottom cover 420, and a spittoon 490 configured to receive and/or store user waste product produced from consuming a smokeless tobacco product. In particular, a container 405 may include a reusable spittoon 490 configured to receive and/or store user waste product during consumption of a smokeless tobacco product in a deployed position, as shown in FIGS. 9A and 9B. The reusable spittoon 490 may be further configured to be to be manipulated between the deployed position, as shown in FIGS. 9A and 9B, and a stored position, as shown in FIG. 10. Although FIGS. 9A, 9B and 10 illustrate the reusable spittoon 490 being operably engaged and/or integrally formed with the bottom cover 420, the reusable spittoon 490 may be operably engaged and/or integrally formed with the intermediate wall 434 such that the spittoon 490 may be deployed from and/or stored within the second compartment, as described herein. In particular, FIGS. 9A, 9B, and 10 illustrate the reusable spittoon 490 being operably engaged and/or integrally formed with an inner bottom surface 423 of a bottom wall 421 of the bottom cover 420.

According to some aspects, the reusable spittoon 490 may include a plurality of concentric annular ring portions 491. In one aspect, the plurality of concentric annular ring portions 491 may have graduated diameters which are extendable from one another along the longitudinal axis of the spittoon 490. In particular, the concentric annular ring portions 491 may be extended longitudinally so as to form and define a spittoon cavity 493. For example, as shown in FIG. 9A, the concentric annular ring portions 491 may be extended longitudinally and may be sequentially sized and dimensioned such that each respective upper ring portion that extends from a respective lower ring portion forms and defines a spittoon cavity 493 that has an increasing diameter as the concentric annular ring portions extend from the bottom cover 420. In another aspect, as shown in FIG. 9B, the concentric annular ring portions 491 may be extended longitudinally and may be sequentially sized and dimensioned such that each respective upper ring portion that extends from a respective lower ring portion forms and defines a spittoon cavity 493 that has a decreasing diameter as the concentric annular ring portions extend from the bottom cover 420.

Additionally or alternatively, the plurality of concentric annular ring portions 491 may be sequentially sized and dimensioned such that each respective lower ring portion is concentrically nested within each respective upper ring portion when the ring portions are stored in a stored position, as shown in FIG. 10. In some aspects, the spittoon 490 may further include a pull tab 499 operably engaged with at least one of the concentric annular ring portions 491, as shown in FIGS. 9A, 9B and 10. In particular, the pull tab 499 may be operably engaged with the uppermost ring portion such that a user may engage the pull tab 499 to move the spittoon from the stored configuration to the open configuration.

In some aspects, the concentric annular ring portions 491 may be configured to be disposed substantially coplanar with respect to one another when the reusable spittoon 490 is disposed in the stored configuration. As such, the height of the reusable spittoon 490 when stored in the stored position may be defined by the height of the concentric annular ring portion 491, which may be less than the height of the second compartment 441. Accordingly, the reusable spittoon 490 may be configured to be fully enclosed within the second compartment when the reusable spittoon 490 is disposed in the stored position.

Referring to FIGS. 9A and 9B, the concentric annular ring portions 491 may each include a ring segment 494 and a flange segment 495. Each of the plurality of concentric annular ring portions 491 (i.e., the ring segment 494 and the flange segment 495) may include a flexible material, and may be flexibly coupled to one another. For example, in some aspects, the annular ring portions 491 may include a silicone material. In another aspect, the plurality of concentric ring portions 491 may include a ring segment 494 that includes a substantially rigid material such as plastic, metal, and/or the like, and a flange segment 495 that includes a flexible material such as silicone and/or the like. Accordingly, the flexible flange segments 495 may still be manipulated such that the substantially rigid ring segments 494 are concentrically nested with respect to one another.

According to another aspect, a container may include a reusable spittoon 590, as shown in FIG. 11, which is configured to be manipulated between a stored position and a deployed position. In some aspects, the reusable spittoon 590 may be configured to be fully enclosed within a first and/or second compartment of a container when disposed in the stored position. In this regard, a reusable spittoon 590 may include a valve assembly 591 configured to provide for fluid communication between the environment and a sealed interior volume 592 of the spittoon 590. As such, the valve assembly 591 may be configured to connect and/or operably engage the sealed interior volume 592 so as to fill the sealed interior volume 592 with a fluid (e.g. air) from the stored position to a deployed position, as shown in FIG. 11. For example, the reusable spittoon 590 may be configured to be inflated with air via the valve assembly 591 such that the reusable spittoon 590 is inflated to the deployed position. Likewise, the sealed interior volume 592 of the reusable spittoon 590 may be deflated from the deployed position such that the sealed interior volume 592 is substantially devoid of air. In this regard, the reusable spittoon 590 may be deflated from the deployed position to a stored position via the valve assembly 591.

When disposed in the deployed position, the sealed interior volume 592 of the reusable spittoon 590 may be substantially filled with a fluid such that the reusable spittoon 590 defines a spittoon cavity 593. Likewise, when the reusable spittoon 590 is manipulated towards the stored position, the fluid within the sealed interior volume 592 may be dispersed to the outside environment through the valve assembly 591 such that the reusable spittoon 590 holds no distinctive shape or structure in the stored position.

According to another aspect, the container 605 may include a cover 610 and a body portion 630, as shown in FIG. 12. In particular, the container 605 may include a body portion 630 defining a first end 631 and a longitudinally-opposed second end 632. Additionally, the body portion 630 may include a bottom wall 633 disposed proximate the second end 632. A first end 631 of the body portion 630 may be configured to operably engage the cover 610 so as to substantially enclose an internal space defined by the body portion. As previously mentioned, the internal space may be configured to receive, house, and/or store a plurality of tobacco-related products, such as a plurality of smokeless tobacco products.

According to some aspects, the body portion 630 may include at least one outer surface. For example, the body portion 630 may include a bottom wall 633 having an outer bottom surface 635 disposed proximate the second end 632 of the body portion. In some aspects, the outer bottom surface 635 may be configured to retain a plurality of disposable spittoons 90, 91, 92, 93, 94, 95 arranged about the periphery of the outer bottom surface 635 of the body portion 630. For example, the plurality of disposable spittoons 90, 91, 92, 93, 94, 95 may be temporarily attached to the outer bottom surface 635 of the body portion 630 with an adhesive material until a consumer removes one of the disposable spittoons for use.

Many modifications and other aspects of the disclosure will come to mind to one skilled in the art to which this disclosure pertains having the benefit of the teachings presented in the foregoing descriptions and the associated drawings. Therefore, it is to be understood that the disclosure is not to be limited to the specific aspects disclosed herein and that modifications and other aspects are intended to be included within the scope of the appended claims. Although specific terms are employed herein, they are used in a generic and descriptive sense only and not for purposes of limitation.

That which is claimed:

1. A container comprising:

a top cover;

a bottom cover;

a body portion configured to engage the top cover and the bottom cover to substantially enclose an internal space defined by the body portion, the body portion comprising an intermediate wall that divides the internal space into a first compartment and a second compartment;

a spittoon disposed within the second compartment; and a dispensing unit configured to provide the spittoon on demand from the second compartment, wherein the dispensing unit comprises:

an outer shell defining a dispensing aperture and a shell cavity; and a base member configured to retain at least one spittoon thereon, wherein the outer shell is configured to operably engage the base member and enclose the base member within the shell cavity.

2. The container of claim 1, wherein the dispensing unit further comprises a biasing element configured to operably engage the base member, wherein the base member being configured to retain at least one spittoon thereon further comprises the base member being configured to retain a stack of disposable spittoons thereon, and wherein operable engagement of the biasing element with the base member causes, at least in part, the base member to direct the stack of disposable spittoons towards the dispensing aperture.

3. The container of claim 1, wherein the outer shell configured to operably engage the base and enclose the base member within the shell cavity further comprises one of the outer shell and the base member to rotate with respect to one another, wherein the base member being configured to retain at least one spittoon thereon further comprises the base member being configured to retain a plurality of disposable spittoons, the plurality of disposable spittoons being arranged about a central axis of the base member in substantially equal angular intervals, and wherein operably engagement between the outer shell and the base member provides for positioning the dispensing aperture proximate to any one of the disposable spittoons.

4. The container of claim 1, wherein the dispensing unit is configured to be received within the second compartment.

5. The container of claim 4, wherein the dispensing unit being configured to be received within the second compartment further comprises the dispensing unit being disposed such that the dispensing aperture is disposed proximate the bottom cover when the bottom cover is operably engaged with the body portion, wherein operable engagement between the bottom cover and the body portion limits access to the dispensing aperture.

* * * * *